United States Patent [19]

Nakai et al.

[11] Patent Number: 4,725,157

[45] Date of Patent: Feb. 16, 1988

[54] PRINTING DEVICE WITH A PAIR OF HOUSINGS COMBINED FOR RELATIVE ROCKING MOTION

[75] Inventors: Toshio Nakai, Nagoya; Osamu Nagata, Hujioka; Kenji Sakakibara, Ichinomiya; Michitoshi Akao; Shigeyuki Hayashi, both of Shimosaka; Toshio Takahashi, Nagoya, all of Japan

[73] Assignee: Brother Kogyo Kabushiki Kaisha, Japan

[21] Appl. No.: 889,724

[22] Filed: Jul. 28, 1986

[30] Foreign Application Priority Data

| | | | |
|---|---|---|---|
| Jul. 29, 1985 | [JP] | Japan | 60-165655 |
| Aug. 28, 1985 | [JP] | Japan | 60-189155 |
| Sep. 18, 1985 | [JP] | Japan | 60-204453 |

[51] Int. Cl.[4] ..... B41J 11/56

[52] U.S. Cl. ..... 400/680; 400/88; 400/683; 400/693; D18/1

[58] Field of Search ..... 400/88, 144.2, 144.3, 400/680, 681, 682, 683, 684, 685, 691, 693; 101/93.19; 312/208, 251, 298, 302; 346/145; D18/1, 2, 12, 99

[56] References Cited

U.S. PATENT DOCUMENTS

| | | | |
|---|---|---|---|
| D. 203,140 | 12/1965 | Cuccio | D18/2 |
| 3,830,352 | 8/1974 | Kolpek | 400/681 |
| 4,245,917 | 1/1981 | Mosciatti et al. | 400/144.2 |
| 4,423,971 | 1/1984 | Hira et al. | 400/144.2 |
| 4,541,748 | 9/1985 | Okumura et al. | 400/144.2 |
| 4,565,128 | 1/1986 | Moriyama et al. | 101/93.19 |

FOREIGN PATENT DOCUMENTS

| | | | |
|---|---|---|---|
| 3311122 | 9/1984 | Fed. Rep. of Germany | 400/144.2 |
| 38822 | 3/1984 | Japan | 400/682 |
| 2135246 | 8/1984 | United Kingdom | 400/144.2 |

OTHER PUBLICATIONS

"Cover Section for Paper Opening of a Printer", IBM TDB; vol. 24, No. 8, p. 4348; W. E. Mott et al.; Jan. 1982.

*Primary Examiner*—Edgar S. Burr
*Assistant Examiner*—David A. Wiecking
*Attorney, Agent, or Firm*—Jones, Tullar & Cooper

[57] ABSTRACT

In a printing device according to the present invention, a housing assembly comprises a pair of housings which are rockably supported, with their respective open end portions abutting against each other. A platen is disposed in an abutment region where the open end portions abut. A keyboard is provided on the one housing, while a printing element is disposed inside the other housing. When the printing device is in a nonusable position, the two housings extend along one plane, thus defining a flat, rectangular outline of the housing assembly. When the device is in a usable position, the housings are rocked relatively, thus defining a substantially L-shaped outline of the housing assembly. As the housings rock in this manner, the printing element is brought to a printing position, where the element faces the platen.

12 Claims, 23 Drawing Figures

PRINTING DEVICE WITH A PAIR OF HOUSINGS COMBINED FOR RELATIVE ROCKING MOTION

BACKGROUND OF THE INVENTION

The present invention relates to printing devices, such as typewriters or printers used in electrical data equipment, using a daisy wheel as a printing element, and more specifically to a printing device, in which a housing assembly includes a pair of housings relatively rockable around an axis, one of the housings carrying a keyboard thereon, and the other housing containing a printing mechanism therein.

In data input operation on the keyboard of the printing devices of this type, it is to be desired that an operator should be able to directly view data printed on a record medium on a platen. Such direct view can be hindered by a printing element, which travels along a print line, facing the platen. In these conventional printing devices, a daisy wheel, matrix-type print head and the like may be used as the print element. The devices are designed so that the direct data view is easy, even with use of a daisy wheel.

FIG. 1 shows one such prior art device using a daisy wheel. As shown in FIG. 1, a circular daisy wheel 4, rotated by a motor 3, is vertically mounted, substantially at right angles to the bottom surface of a housing 5, in order to facilitate the direct view of characters, printed on a printing sheet 2 on a platen 1. By doing this, types 4*a* on the wheel 4 can be located outside the operator's view. In this case, however, the wheel 4 has a considerable diameter, so that the height of the housing 5 of the device, which must be much greater than the diameter of the wheel 4, is substantial. Inevitably, therefore, the device is heavy and bulky to store or carry about.

In order to eliminate such a drawback, an improved printing device has been proposed and stated in Japanese Utility Model Disclosure No. 60-8072. In this device, the types 4*a* of the daisy wheel 4 are inclined at an angle to the bottom surface of the housing 5, so that the device is reduced in height, as shown in FIG. 2. In this case, however, characters, printed on the sheet 2, would be hidden behind the types 4*a* of the wheel 4 and a ribbon (not shown) between the types 4*a* and the sheet 2. In this arrangement, the printed characters can be seen only after shifting their position upward by turning the platen 1, and they must be returned to the original position for the printing of the next character. According to this method, however, the typing speed is lowered, due to a time lag, and the printing point may possibly be dislocated by the movement of the platen 1. If the device is provided with a liquid crystal display (LCD), the print can be checked, only indirectly, through the LCD. The use of the LCD would increase the cost of the device.

In the conventional printing devices, moreover, the keyboard gradually declines toward a typist or operator, for his easier view and operation of the keys. Naturally, therefore, the rear side of the housing must be made relatively high or thick. Thus, the housing is inevitably bulky and heavy, and cannot enjoy a compact design.

For the miniaturization of the printing devices, furthermore, there has been proposed an arrangement such that a housing assembly is formed of a pair of housings, which can rock relatively to each other. Printing devices of such an arrangement are stated in U.S. Pat. No. Des. 203,140 and Japanese patent disclosure No. 59-38822. In either of these devices, a keyboard is mounted on the one housing, while a printing mechanism is contained in the other housing. The two housings are coupled, for relatively rocking motion around an axis, by hinge-type pivot means. During use, the housings are stretched flat. When not in use, they can be bent over upon each other or closed, for compactness.

Neither of these printing devices can, however, settle those problems mentioned in connection with FIGS. 1 and 2.

SUMMARY OF THE INVENTION

The object of the present invention is to provide a novel printing device, in which a housing is substantially reduced in height, thus making the device more compact and lighter in weight, and which, in use, enables an operator to perform an efficient typing operation.

In order to achieve the above object, a printing device according to the present invention is constructed so that first and second housings, each having an open end portion, are pivotally supported for relative rocking motion, with their respective open end portions abutting against each other. A platen is disposed in an abutment region where the open end portions abut. When the device is in a nonusable position, the housings are stretched, defining a flat, rectangular outline of a housing assembly, which is formed of the housings. In shifting the device to a usable position, the one housing is rocked relatively to the other, thus defining a substantially L-shaped outline of the housing assembly. As the housings are relatively rocked to the usable position, a printing element of a printing mechanism is located in a printing position, where it faces the platen.

According to the arrangement of the invention, as described above, a keyboard is provided on the first housing, while the printing mechanism is contained in the second housing. When in use, the housings are inclined at an angle to each other, thus forming a substantially L-shaped configuration. In this state, the front end portion of the first housing, on the front side nearer to the operator, and the rear end portion of the second housing, on the rear side remoter from the operator, serve as support legs, resting on a surface on which the device is placed. Thus, the first housing is inclined, so that the lines of keys ascend toward the rear side, for the ease of the operator's operation on the keyboard. If the printing element is a daisy wheel, its wheel plane can be positioned substantially parallel to a bottom plate of the second housing, inside the second housing. By rocking the second housing to the usable position, the wheel can be raised up so that its plane is substantially perpendicular to the device mounting surface, to be located in the printing position, facing the platen.

Thus, the housing assembly, formed of the first and second housings, can be made flat and low-profiled, permitting miniaturization and light-weight design of the printing device. If the printing element is a daisy wheel, such improvement can be achieved without regard to the diameter of the wheel.

According to a preferred specific arrangement of the present invention, the axis of rocking motion of the first and second housings is coaxial with the shaft of the platen. When the second housing rocks relatively to the first housing, therefore, the printing element can move, around the platen, to the printing position, while maintaining a fixed distance from the platen. As a result, the layout and location of various mechanical parts are easy.

According to another preferred arrangement of the invention, resilient closing means is provided between the respective bottom plates of the first and second housings, in the abutment region where the open end portions of the housings abut against each other. Thus, even if the housings rock relatively to each other, the gap between their bottom plates is always closed, within the range of their rocking motion, so that external dust can be prevented from entering the device. The resilient closing means may be formed of a shutter plate, which is spring-urged, and slidably mounted on the bottom plate of the first housing. In this case, the operator can enjoy easy access to the inside of the device, for maintenance or inspection, by sliding the plate to expose the bottom portion of the first housing.

According to still another preferred arrangement of the invention, switch means may be provided, which operates as the second housing is rocked relatively to the first housing, between the usable and nonusable positions. When the second housing is restored from the usable position to the nonusable position, the switch means is automatically activated to disconnect the device from the power supply.

Thus, if the operator should fail to turn the main switch off, after the end of the operation of the device, no trouble would occur, on account of the override.

According to a further preferred arrangement of the invention, the first housing is provided with a ribbon cassette unit for supporting a ribbon cassette, while the second housing is provided with a print head unit for supporting the printing element. These two units can be moved in synchronism with each other, along a print line, by wire means for drive transmission. The wire means is provided with tension adjusting means which, having its stretch length variable, serves to keep the tension of the wire means substantially fixed.

Thus, even though the housings rock between the nonusable and usable positions, the tension of the wire means and the relative positions of the units, connected to the wire means, can be kept stable at all times. With this arrangement, the units can be driven by a common drive source, without requiring their respective sources. In consequence, the device is simple in construction, low in manufacturing cost, and small-sized.

These and other aspects and advantages of the present invention will be more completely described below with reference to the accompanying drawings.

BRIEF DESCRIPTION OF THE DRAWINGS

FIGS. 3 and 4 are perspective views showing an outline of a printing device according to a first embodiment of the present invention, in which FIG. 3 shows a nonusable position of the device, and FIG. 4 shows a usable position;

DETAILED DESCRIPTION OF THE PREFERRED EMBODIMENTS

Preferred embodiments of the present invention will now be described in detail with reference to the accompanying drawings of FIGS. 3 to 23.

Figure 1:
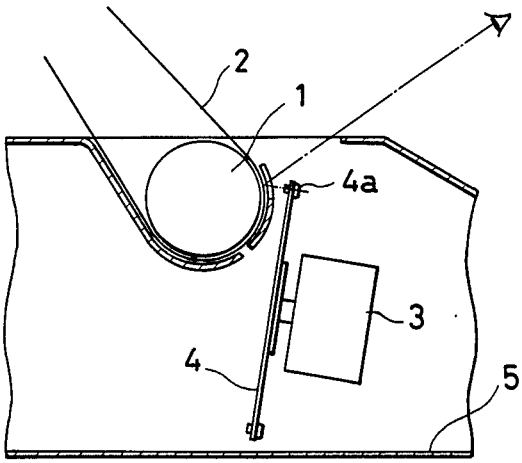
FIG. 1 PRIOR ART
FIGS. 1 and 2 are vertical sectional views showing a principal part of a prior art printing device, with a daisy wheel as a printing element.
Figure 2:
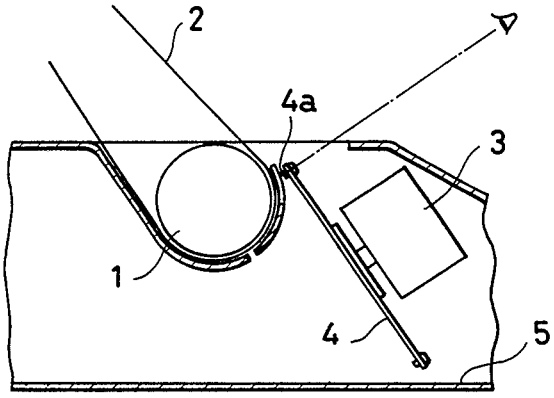
FIG. 2 PRIOR ART
Figure 3:
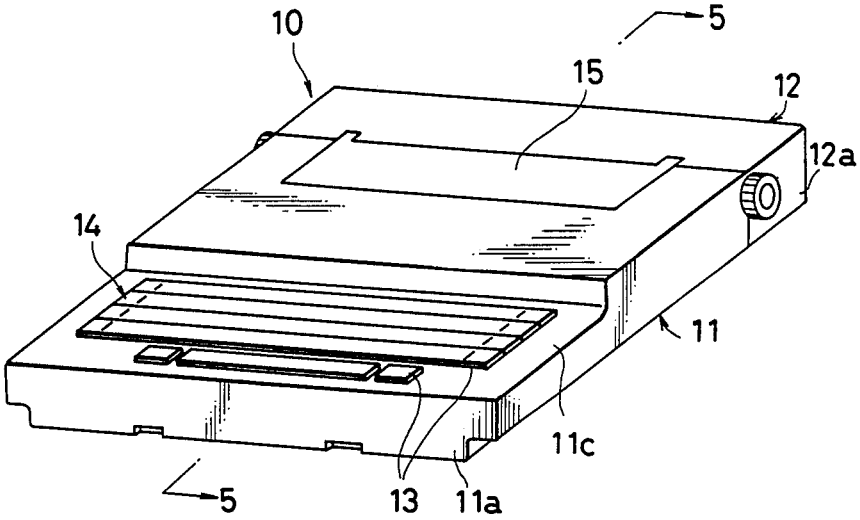
Figure 4:
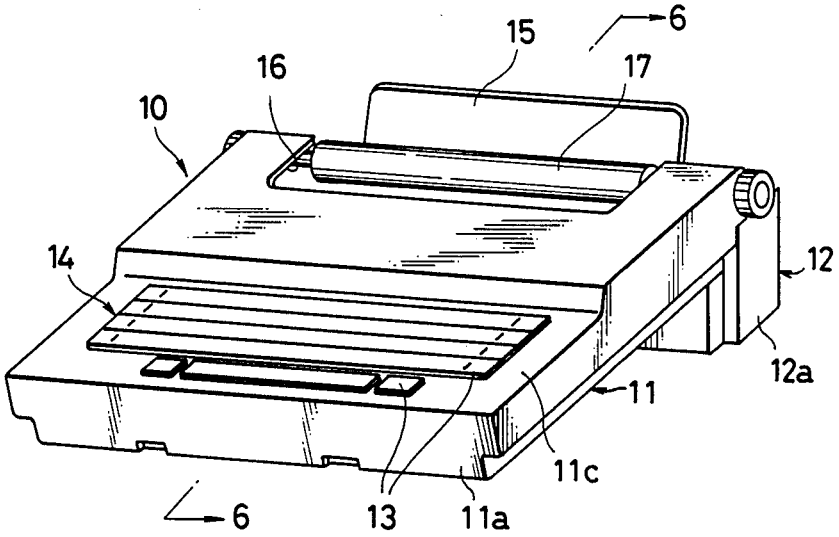

FIGS. 3 and 4 show an outline of a printing device according to a first embodiment of the present invention. In FIG. 3, the device is flat, that is, in a nonusable position. In FIG. 4, the device is bent or in a usable position, to be ready for use. A housing assembly 10 of the printing device includes a first box-shaped housing 11 on the front side, and a second box-shaped housing 12 on the rear side. A keyboard 14, bearing a plurality of keys 13, such as character keys and sign keys, is mounted on the front portion of the top surface of the first housing 11. The keys on the keyboard 14 are mounted flush with the top surface of the first housing 11, and there are no differences in level between individual lines of keys.

In the description herein, the "front side" is the side facing the operator, while the "rear side" is the side more remote from the operator.

When the printing device is not ready for use, or in the nonusable position, both housings 11 and 12 of the housing assembly 10 are in an unfolded state, extending straight in the horizontal direction, thus defining a flat, rectangular outline of the assembly 10, as shown in FIG. 3. In setting the device in the usable position, where it is ready for use, the housings 11 and 12 are rocked relatively by the operator's manual operation, thus defining a substantially L-shaped outline, as viewed sideways, of the assembly 10, as shown in FIG.

4. In this state, a front end portion 11*a* of the first housing 11, especially its lower edge portion, and a rear end portion 12*a* of the second housing 12, serve as legs to rest on the surface of a structure on which the device is placed. Thus, the first housing 11 is kept aslant or ascending toward the rear side. This bent position is also seen from FIG. 6. As the flat first housing 11 inclines in this manner, the keyboard 14, which is mounted on a top plate 11*c* of the first housing 11, ascends backward, correspondingly. This facilitates the operator's key operation. In the usable position, as shown in FIG. 4, a paper guide 15 for the insertion of printing paper, is raised as the second housing 12 is bent down. In this state, a printing window or aperture 16, formed in the rear portion of the top face of the first housing 11, is opened, so that a cylindrical platen 17 is exposed through the aperture 16, and a guide path for printing paper is defined.

In the nonusable position, the aperture 16 is closed by the paper guide 15, which forms a flat surface, flush with the top faces of the first and second housings 11 and 12, and serves also as a cover to prevent external dust from entering the device through the aperture 16.

Figure 5:
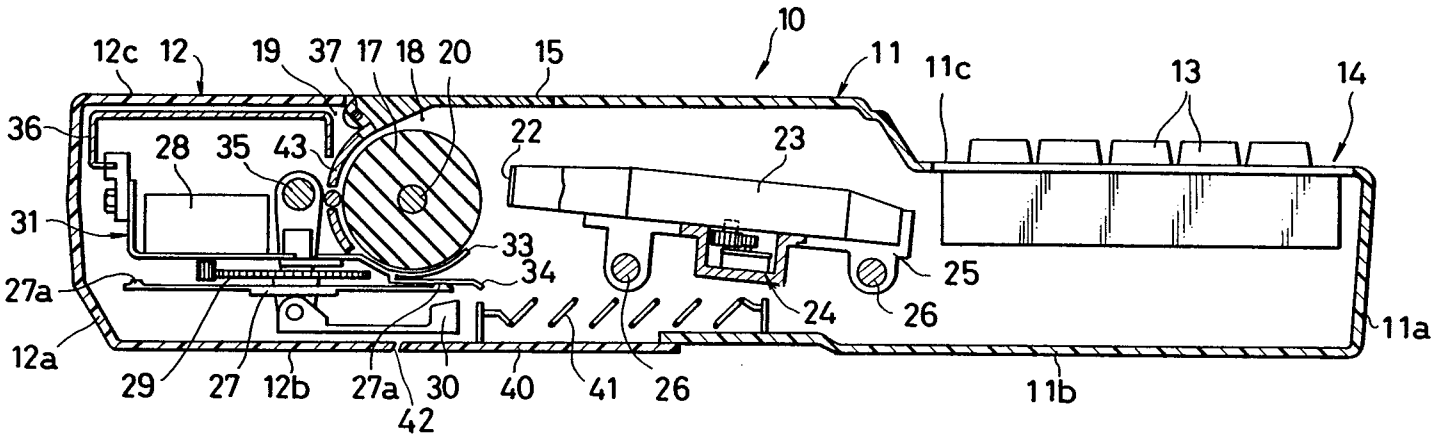
FIG. 5 is a vertical sectional view taken along line 5—5 of FIG. 3.

As shown in FIG. 5, the first and second housings 11 and 12 have open end portions 18 and 19, respectively, at which the housings 11 and 12 abut against each other, and are joined together for relative rocking motion. The platen 17 lies in an abutment region between the open end portions 18 and 19, extending in the transverse direction of the device, that is, along a print line. A platen shaft 20 is mounted on opposite side walls of the housings 11 and 12, so as to be coaxial with the axis of rotation of the housings 11 and 12. The shaft 20 is supported on the side walls of the housings 11 and 12 by means of suitable bearings (not shown).

Arranged inside the first housing 11 are a ribbon cassette 23, containing a ribbon 22 which faces the platen 17, and a ribbon drive unit 24 for winding the ribbon 22. The ribbon cassette 23 and the ribbon drive unit 24 are held by a ribbon carriage 25, which can move along the print line, guided by a pair of guide shafts 26, lying between the side walls of the first housing 11.

Inside the second housing 12, on the other hand, there is a daisy wheel 27, as a printing element, which includes a plurality of radial spokes, and types 27*a* attached individually to the extreme ends of the spokes. The plane of the wheel 27 is kept substantially parallel to a bottom plate 12*b* of the second housing 12. In the nonusable position, the wheel 27 is located under and behind the platen 17. A character selection motor 28 is coupled to the daisy wheel 27, by means of an intermediate driving gear 29, lying over the wheel 27 and behind the platen 17. The motor 28 is formed of a stepping motor, which selectively move the types 27*a* to a printing point in response to the operation of keys 13 on the keyboard 14. A printing hammer 30 is disposed on the opposite side of the wheel 27 to the platen 20, so as to face the selected type 27*a* of the daisy wheel 27. The printing hammer 30 is driven by a hammer drive mechanism (not shown), which is formed of a solenoid or the like. The hammer drive mechanism is actuated in response to the operation of the keys 13, and rocks the hammer 30 in the printing direction.

The daisy wheel 27, character selection motor 28, and printing hammer 30, which constitute a unitized printing mechanism, are mounted on a head carriage 31. The head carriage 31 is fitted integrally with a paper guide 33 for guiding a printing sheet 32 (FIG. 6) and a ribbon guide 34 for supporting and guiding the ribbon 22 of the ribbon cassette 23. The paper meter 33 is always located close to and along the outer peripheral surface of the platen 17. The head carriage 31 can move along the print line, guided by a guide shaft 35 and a guide plate 36, which lie between the side walls of the second housing 12.

The guide shafts 26 and 35 extend parallel to each other, so that the carriages 25 and 31, guided by the shafts 26 and 35, respectively, can move synchronously over equal distances, in the same direction, with the platen 17 between them. Thus, the ribbon cassette 23 and the daisy wheel 27 are arranged so as to be movable along the print line, in fixed positional relation, during printing operation.

The first and second housings 11 and 12 are arranged so as to be rockable around the shaft 20 of the platen 17, with their open end portions 18 and 19 facing each other, as mentioned before. For example, the housings 11 and 12 may be rockably mounted on the platen shaft 20 by means of conventional bearings, individually.

The relative rocking motion of the first and second housings 11 and 12 ranges between two end positions or motion limits. In the one position, corresponding to the nonusable position (FIG. 5), the upper and lower surfaces of the one housing are flush with their corresponding surfaces of the other. The other position corresponds to the usable position (FIG. 6), in which the housings 11 and 12 constitute a substantially L-shaped configuration. In stopping or locating the first and second housings 11 and 12 at the motion limits, suitable portions of the housings 11 and 12 are made to abut against each other. In this embodiment, as seen from FIGS. 3 and 4, the side plates of the housings 11 and 12 are caused to engage each other, at the limit-end positions.

Figure 6:
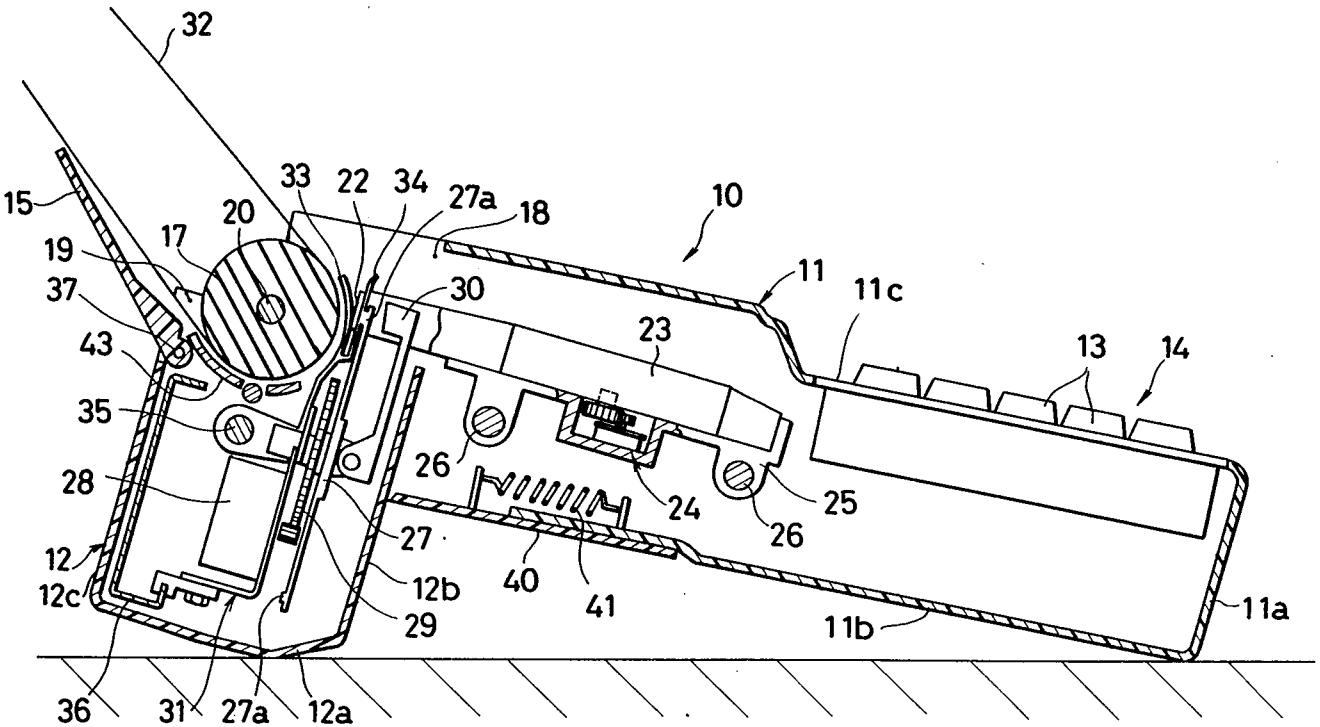
FIG. 6 is a vertical sectional view taken along line 6—6 of FIG. 4.

When the device is in the nonusable position, the daisy wheel 27 and the printing hammer 30, mounted inside the second housing 12, are located at a substantial distance from the ribbon cassette 23 in the first housing 11. In starting operation of the device, however, the second housing 12 is rocked relatively to the first housing 11, so that the wheel 27 and the hammer 30 rotate around the shaft 20 of the platen 17, while maintaining the fixed positional relation, as shown in FIG. 6. As a result, the type 27*a* of the wheel 27 and the hammer 30 line 15, between "30" are set in the printing position, where they are opposed to the platen 17 across the ribbon 22 in the ribbon cassette 23.

The paper guide 15 is rockably mounted on a top plate 12*c* of the second housing 12, at the open end portion 19 thereof, by means of shaft means 37. When the device is in the nonusable position, the paper guide 15 covers the printing aperture 16, as mentioned before, thereby protecting the daisy wheel 27, ribbon cassette 23, and platen 17 from dust and the like.

A bottom plate 11*b* of the first housing 11 is fitted with a shutter plate 40, which slides along the bottom plate 11*b*. A compression spring 41 is anchored between the shutter plate 40 and the inside of the bottom plate 11*b* of the first housing 11. The spring 41 always urges the shutter plate 40 to abut against the bottom plate 12*b* of the second housing 12. The shutter plate 40 and the spring 41 constitute resilient closing means, which always closes the gap between the respective bottom plates 11*b* and 12*b* of the housings 11 and 12, in the abutment region.

In the nonusable position, the shutter plate 40 engages an end edge 42 of the bottom plate **12*b* of the second housing 12, urged by the spring 41, thereby covering the underside of the abutment region between the first and second housings 11 and 12. When the device is bent from the nonusable position to the usable position, as shown in FIG. 6, the shutter plate 40 is pressed, against the urging force of the compression spring 41, toward the front end of the first housing 11, by the bottom plate 12*b* of the second housing 12. Also in this bent state, the shutter plate 40 covers the underside of the gap between the first and second housings 11 and 12. Thus, without regard to the position of the device, the shutter plate 40 covers the underside of the abutment region between the housings 11 and 12**, thereby positively preventing external dust and other foreign matter from entering the device through that bottom portion.

Mounting means, for slidably mounting the shutter plate 40 on the bottom plate **11*b* of the first housing 11, is not shown in detail in FIG. 6**. This means may be formed of any suitable conventional means, such as an arrangement including pin and slot.

Instead of using the shutter plate 40, the resilient closing means may be formed of a flexible sheet, which connects the respective bottom plates **11*b* and 12*b* of the housings 11 and 12. The shutter plate 40 of this embodiment, which can be slid against the urging force of the spring 41**, has an advantage over the flexible seat, in facilitating the operator's replacement of internal parts and other maintenance work.

The printing operation of the printing device, constructed in this manner, will be described in detail.

First, the operator manually rocks the second housing 12 downward around the platen shaft 20, thereby setting the device in the usable position, as shown in FIG. 6. If he then inserts the printing sheet 32 along the paper guide 15, and operates a paper feed key on the keyboard 14, the platen 17 is rotated by a paper feed motor (not shown). As a result, the printing sheet 32 is fed between the platen 17 and the ribbon 22, guided by a paper pan 43 and the paper meter 33, which surround the platen 17. Thus, the device is ready for the printing operation.

If the operator depresses one of keys 13, such as character keys, on the keyboard 14, an input signal corresponding to the depressed key is applied to control means (not shown), such as a central processing unit (CPU), in the device. In response to the output signal of the control means, the character selection motor 28 rotates, so that the daisy wheel 27 is rotated through the medium of the intermediate gear 29, thereby moving the type **27*a* corresponding to the key 13 to the printing point. At the same time, the hammer drive mechanism is actuated to drive the printing hammer 30 toward the platen 17. Thereupon, the hammer 30 strikes at the rear face of the selected type 27*a*. As a result, the struck type 27*a* abuts against the printing sheet 32 on the platen 17, with the ribbon 22 between the type 27*a* and the sheet 32**. Thus, an entire printing cycle for one character is completed.

If another one of the keys 13 is depressed, the ribbon carriage 25 and the head carriage 31 are moved transversely along the print line, in synchronism with each other. Thus, another printing cycle is accomplished in the same manner as aforesaid.

In the embodiment described above, the printing device is provided with a daisy wheel for use as a printing element. Alternatively, the present invention may be applied to a printing device which has a printing element of an endless-belt type or chain type, or a matrix-type print head.

In order to hold the housings 11 and 12 more securely in their respective motion-limit positions, according to the present embodiment, the housings may be provided individually with engaging members which engage each other in a spring-urged manner, so that the housings are releasably locked to the limit positions. Moreover, a manual operating lever may be provided for releasing the locked state.

Instead of using the spring 41 for urging the shutter plate 40, furthermore, a bellows-shaped resilient member may be stretched between the shutter plate 40 and the first housing 11.

Referring now to FIGS. 7 to 13, a second embodiment of the printing device of the present invention will be described. In the description to follow, like reference numerals refer to like portions as used in the first embodiment. A detailed description of those portions is omitted herein.

Figure 7:
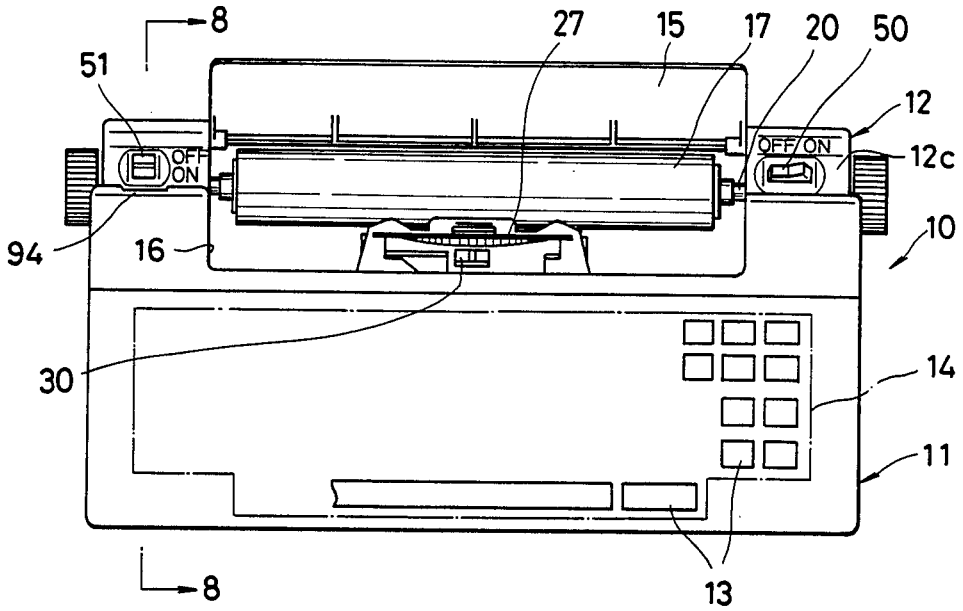
FIG. 7 is a plan view of a printing device according to a second embodiment of the invention, in the usable position.
Figure 8:
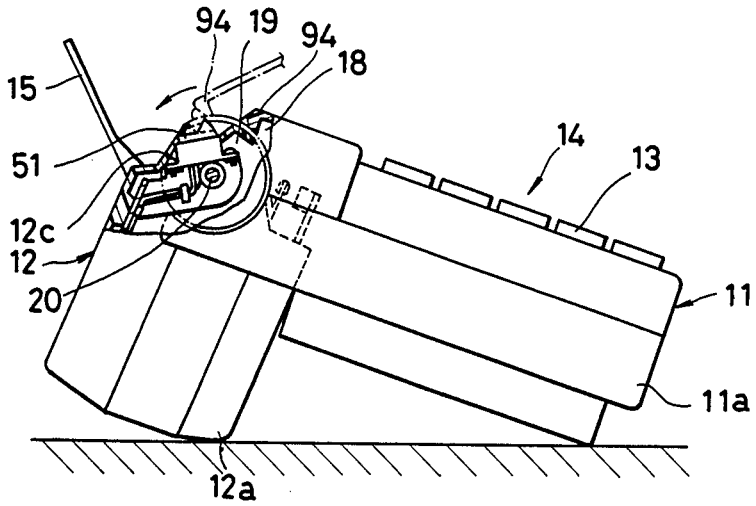
FIG. 8 is a side view, partially in section as taken along line 8—8 of FIG. 7.

In FIGS. 7 and 8, the printing device is in the usable position. The first housing 11, on the front side, and the second housing 12, on the rear side, are supported for relative rotation around the platen shaft 20 of the platen 17. In the usable position, the housing assembly 10 has a substantially L-shaped outline. Thus, the lower end edge of the front end portion **11*a* of the first housing 11, and the rear end portion 12*a* of the second housing 12, serve as legs to rest on the surface on which the device is placed. In the usable position, the keyboard 14 on the first housing 11 ascends toward the rear side, thus providing differences in level between the lines of keys 13, for the ease of the operator's operation, as shown in FIG. 8**.

The paper guide 15, pivotally mounted on the top plate **12*c* of the second housing 12, is located in a paper guide position, where it leaves the printing aperture 16** open.

As shown in FIG. 7, the top plate **12*c* of the second housing 12 is mounted with a main switch 50 and a sub-switch 51, on the right and left, respectively, of the paper guide 15. The switches 50 and 51**, which are each formed of a snap switch of an on-off type, will be described in detail later.

Figure 9:
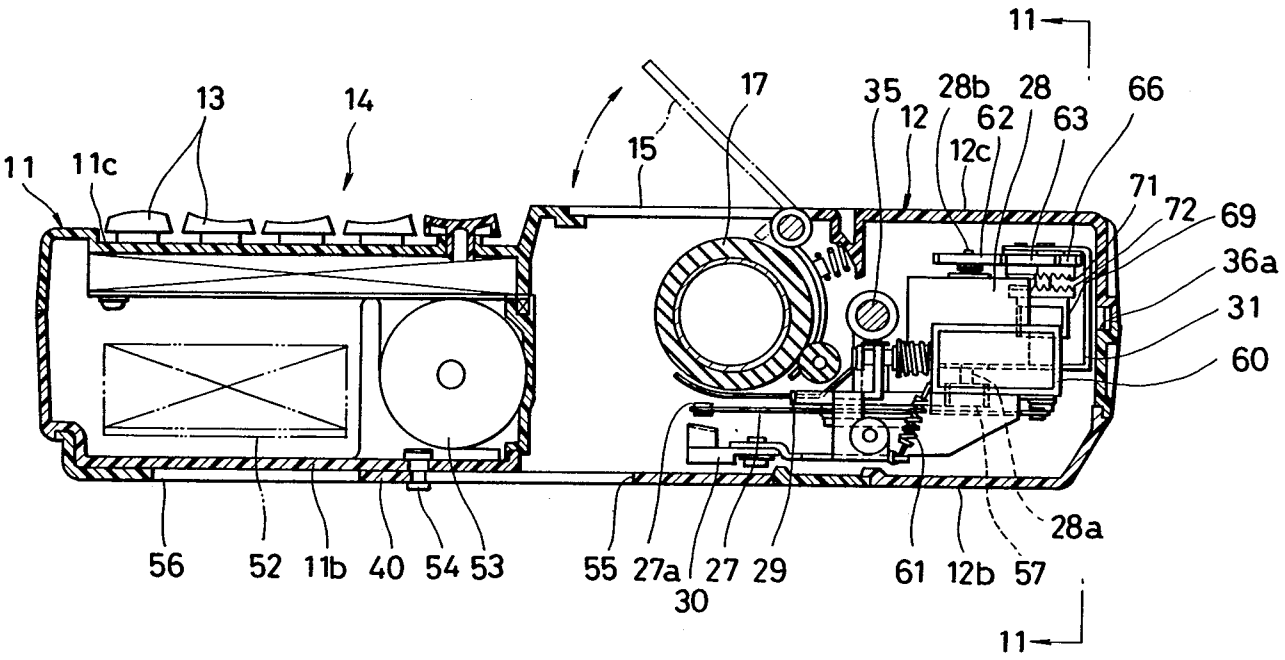
FIG. 9 is a vertical sectional view of the printing device according to the second embodiment, in the nonusable position.
Figure 10:
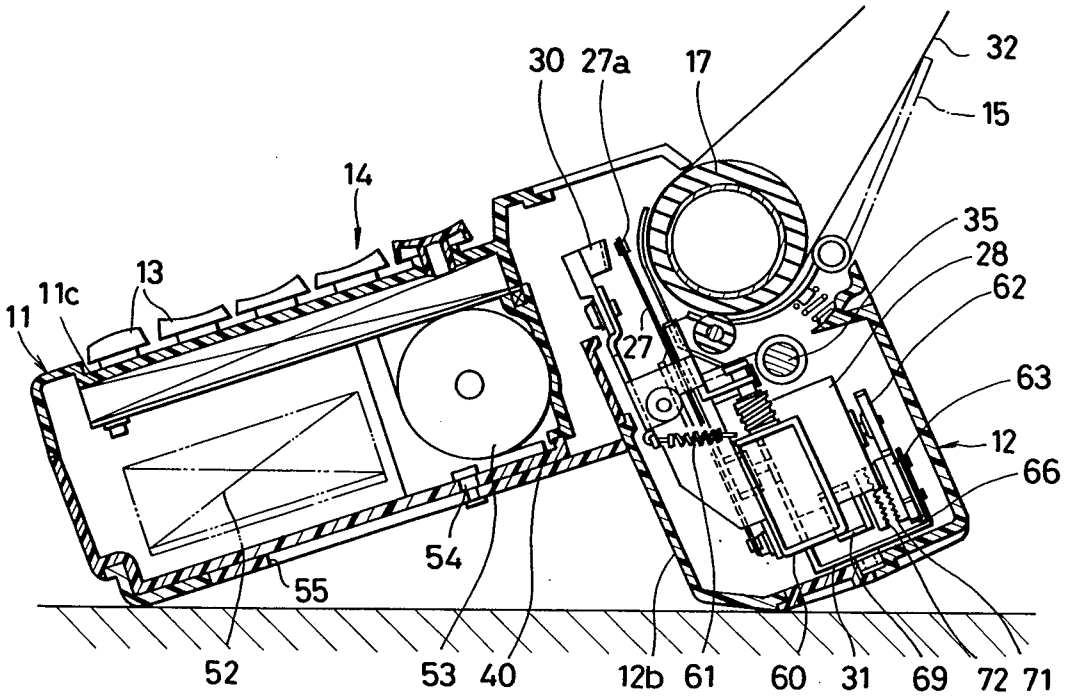
FIG. 10 is a vertical sectional view of the printing device according to the second embodiment, in the usable position.

FIGS. 9 and 10 show the nonusable and usable positions of the device, respectively, corresponding to FIGS. 5 and 6 showing the first embodiment. As in the first embodiment, the daisy wheel 27 is used as a printing element. The plane of the wheel 27, which extends parallel to the bottom plate **12*b* of the second housing 12, is located under and behind the platen 17** when the device is in the nonusable position.

Numerals 52 and 53 designate a control board and a battery serving as a drive power source of the device, respectively. Both the board 52 and the battery 53 are located under the keyboard 14, inside the first housing 11.

The shutter plate 40, serving as the resilient closing means, is slidably mounted on the bottom plate **11*b* of the first housing 11, by means of a pin 54 and a slot 55 in engagement with each other. The pin 54 is fixed to the bottom plate 11*b* of the first housing 11, while the slot 55 is bored through the shutter plate 40, extending along the sliding direction of the plate 40. The plate 40 functions in the same manner as the one used in the first embodiment. In FIGS. 9 and 10, the spring for urging the plate 40 toward the second housing 12** is omitted for the simplicity of illustration.

The shutter plate 40 is guided so as to slide in a guide recess 56, which is formed in the bottom plate 11*b* of the first housing 11.

Inside the second housing 12, the stepping motor 28 is mounted on the head carriage 31, which is supported by the guide shaft 35, extending parallel to the platen 17, and a guide groove 36*a*, so as to be movable along the platen 17. Output shafts 28*a* and 28*b* project from the lower and upper ends of the motor 28, respectively.

Figure 11:
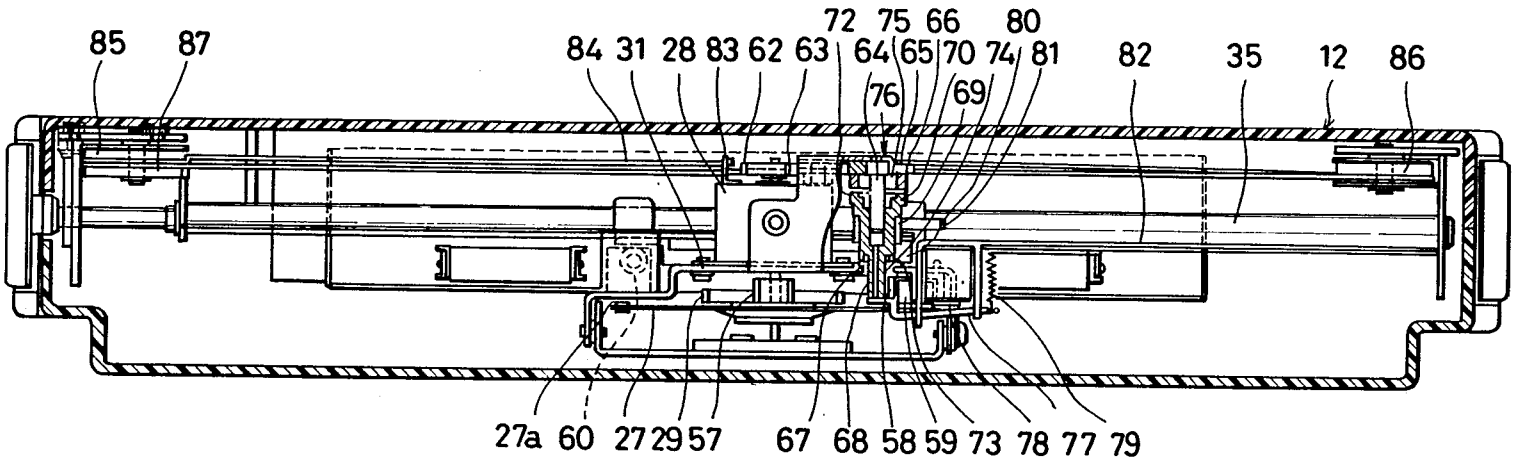
FIG. 11 is a rear-side sectional view taken along line 11—11 of FIG. 9.
Figure 13:
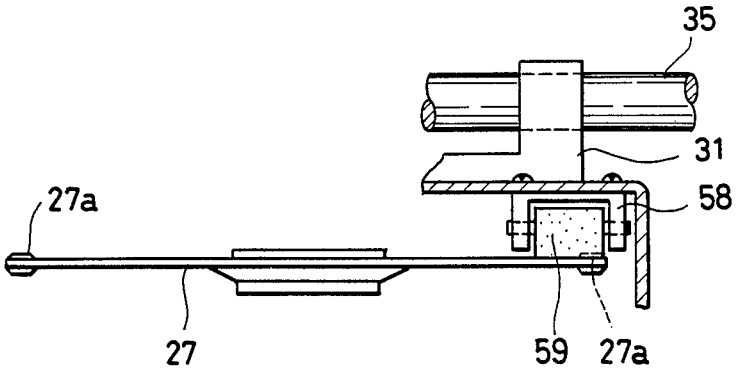
FIG. 13 is a partial enlarged view showing the relative positions of a daisy wheel and an ink roll.

A pinion gear 57 is fixed to the lower output shaft 28*a* of the stepping motor 28. The gear 57, which is rockably mounted on the carriage 31, is in mesh with the intermediate driving gear 29, as the drive means for driving the daisy wheel 27. The wheel 27, for use as the printing element, is rockably mounted on the carriage 31, and has a plurality of types 27*a* arranged along the outer periphery of its top surface, corresponding to the individual keys 13 of the keyboard 14. Between the types 27*a* of the daisy wheel 27 and the carriage 31, as shown in FIGS. 11 and 13, there are an ink-roll base 58, removably attached to the carriage 31, and an ink roll 59 rotatably supported on the base 58 and in contact with the surface of the types 27*a*. As the wheel 27 rotates, oil ink, contained in the ink roll 59, is applied to the surface of each type 27*a* in contact with the roll 59. The hammer 30 is rockably mounted on the carriage 31. It strikes against the rear face of each type 27*a* when a hammer-operating solenoid 60, mounted on the carriage 31, is energized. When the solenoid 60 is off, the hammer 30 is located in a nonoperative position off the types 27*a*, urged by a tension coil spring 61.

The arrangement of this embodiment, using the ink roll 59, require neither an ink ribbon nor a ribbon cassette or other ribbon supporting means. The ribbon cassette, in particular, requires a substantial space in the printing device, whether it is of a movable type or a stationary type. Thus, the ink-roll-type printing device of the second embodiment is preferable for the sake of compact design.

According to the second embodiment, moreover, the ink roll 59, along with the daisy wheel 27, is mounted on the carriage 31, so as to be rockable in one with the wheel 27. Therefore, the printing point, where the daisy wheel 27 faces the platen 17, can be located at various angular positions around the platen 17. In the arrangement using the ink ribbon, on the other hand, the ribbon is located corresponding to a fixed position relative to the platen 17, so that the printing point of the daisy wheel 27 is invariable. Only if the printing point is variable, the operator can select the optimum angular position of the daisy wheel 27, for a direct view of each character printed on the printing sheet. Such selection is achieved by adjusting the angle formed between the first and second housings 11 and 12. Means for releasably locking the housings 11 and 12, at each adjustable position, can be designed with ease. Also, by adjusting the angle between the housings 11 and 12, the desired tilt angle of the keyboard 14 can be selected.

Figure 12:
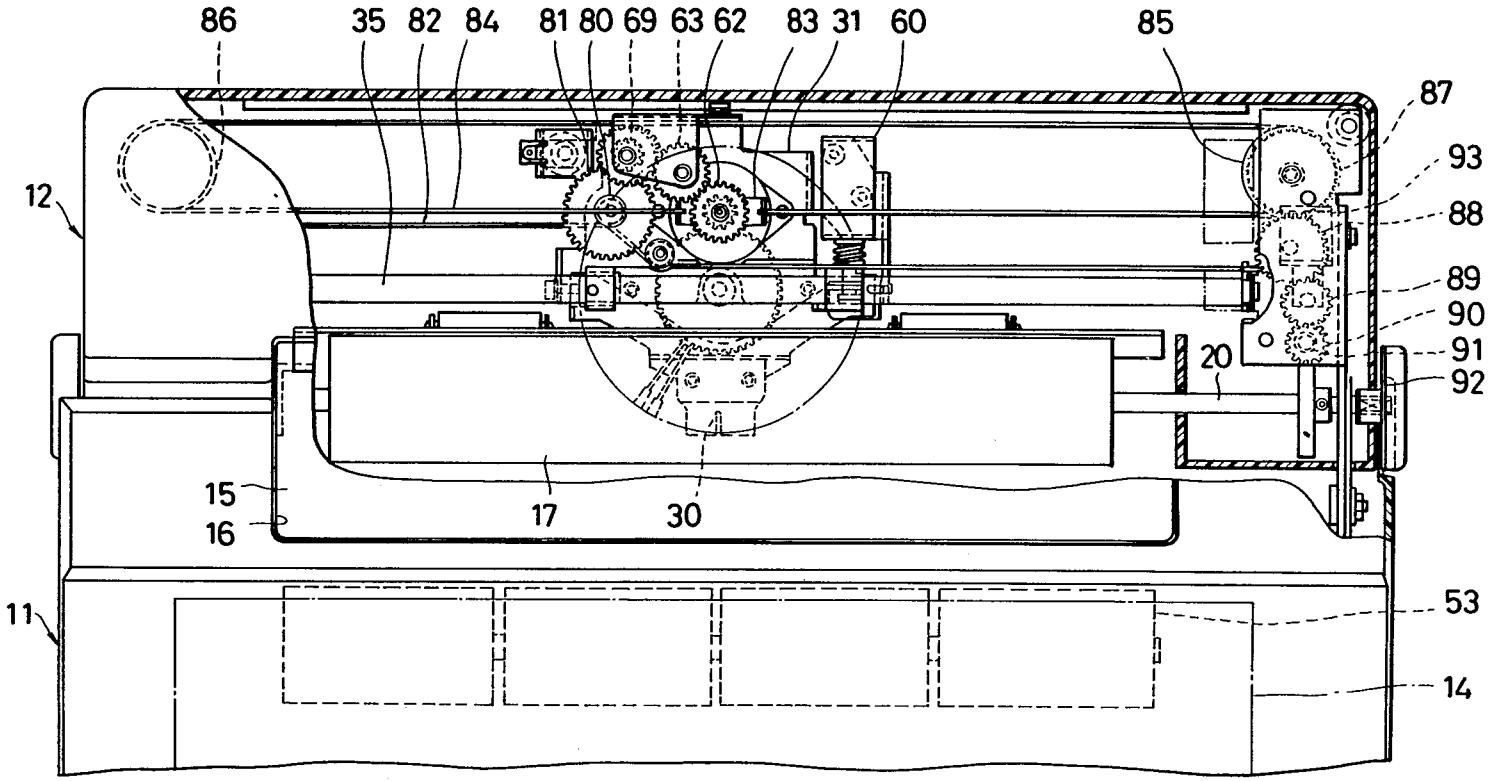
FIG. 12 is a cutaway, partial plan view of the device shown in FIG. 9.

As shown in FIGS. 11 and 12, a first driving gear 62, used to drive the carriage 31, is mounted on the upper output shaft 28*b* of the stepping motor 28. The gear 62 is in mesh with a first transmission gear 63, which is rockably supported on the carriage 31. The gear 63 is in mesh with a first intermediate gear 66 fitted on an upper block 65, which is rockably supported on the carriage 31 by means of an upper support shaft 64. Also rockably supported by the upper support shaft 64, is an intermediate block 70 disposed under the upper block 65. The lower part of the intermediate block 70 is rockably supported on a lower block 67, mounted on the carriage 31, by means of a lower support shaft 68. Moreover, the intermediate block 70 is formed, on its outer periphery, with a second intermediate gear 69, which is smaller in diameter than the first intermediate gear 66. First upper engaging teeth 71 and second upper engaging teeth 72, capable of engaging one another, are formed on the axially facing surfaces of the upper and intermediate blocks 65 and 70, respectively. Likewise, first lower engaging teeth 73 and second lower engaging teeth 74, capable of engaging one another, are formed on the axially facing surfaces of the lower and intermediate blocks 67 and 70, respectively. A compression coil spring 75 is disposed between the upper and intermediate blocks 65 and 70, whereby the upper engaging teeth 71 and 72 are disengaged, and the lower engaging teeth 73 and 74 are caused to engage one another. The upper, lower, and intermediate blocks 65, 67 and 70 and the compression coil spring 75 constitute a clutch assembly 76, whereby the engaging surfaces are moved axially for engagement and disengagement. A backup member 77 is disposed at the lower end of the lower support shaft 68 of the intermediate block 70, whereby the block 70 is urged upward. The backup member 77 pushes up the lower support shaft 68, by the agency of magnetic force from a first switching solenoid 78 of the clutch assembly 76, which is mounted on the carriage 31. A tension coil spring 79 is anchored to the backup member 77, whereby the member 77 is prevented from pressing the lower support shaft 68 when the first solenoid 78 is deenergized. The second intermediate gear 69 of the intermediate block 70 engages a second transmission gear 81, which is rockably supported on the carriage 31 and formed integrally with a driving pulley 80 for driving the carriage 31. A wire 82, with both two opposite ends fixed to the second housing 12, is passed around the driving pulley 80. Thus, as the pulley 80 rotates, the carriage 31 moves along the guide shaft 35. A wire 84 is fixed to the stepping motor 28 by means of a wire support member 83. The wire 84 is passed around a pair of guide pulleys 85 and 86, which are rockably supported on the second housing 12. A second driving gear 87, used to drive the platen 17, is linked to the one guide pulley 85 (on the left-hand side of FIG. 11). The gear 87 is located so as to successively engage third, fourth, and fifth transmission gears 88, 89 and 90, which are rockably supported on the second housing 12. The fifth transmission gear 90 is linked to a worm gear 91, which is in mesh with a worm wheel 92 fixed on the platen shaft 20. The fourth transmission gear 89 is provided with a clutch mechanism (not shown), which controls the engagement and disengagement between the fourth and fifth transmission gears 89 and 90. The clutch mechanism is shifted by a second switching solenoid 93, which is mounted on the second housing 12.

The main switch 50 is provided on the top plate 12*c* of the second housing 12, at the open end portion 19 thereof, which is covered by the open end portion 18 of the first housing 11 when the device is in the nonusable position, and is exposed when the device is in the usable position, as shown in FIGS. 7 and 8. In the exposed state, the main switch 50 can be manually operated for the connection or disconnection of the power. The switch 50 serves to make and break the electrical connection between the battery 53 and an electric circuit (not shown), which is disposed over the control board 52. Like the main switch 50, the sub-switch 51 is provided on the top plate 12c of the second housing 12, at the open end portion 19 thereof. When the device is in the nonusable position, the sub-switch 51 serves to automatically shut off the power. When in the usable position, the sub-switch 51 can be manually operated for the connection of the power. Connected between the main switch 50 and the control board 52, the sub-switch 51 constitutes power-shut-off means for controlling the electrical connection between the battery 53 and a power circuit. Since the switches 50 and 51 are connected in series, the power will be shut off if either of them is turned off.

When the second housing 12 is rocked from the usable position to the nonusable position, the sub-switch 51 is engaged by a switch operating piece 94 (indicated by chain line in FIG. 8), which protrudes integrally from the rear end edge of the top plate 11c of the first housing 11, at the open end portion 18 thereof. As result, the switch 51 is forced back to its off position, so that the power is shut off automatically. Thus, the sub-switch 51 is located on the path of travel of the switch operating piece 94 which moves as the two housing 11 and 12 rock relatively.

What this switch arrangement, the power can be automatically shut off for safety's sake, if the operators fail to return the main switch 50 to the off-positon.

when the device of the invention is in the usable position, both the switches 50 and 51 are exposed to the outside, as shown in FIG. 7. if the operator pushes the switches 50 and 51 to turn them on, the device is connected to the power supply, thus getting ready for the printing operation.

In operating the key 14 for printing on the printing sheet 32, the first switching solenold 78 is turned off. Thereupon, by the action of the compression coil spring 75, the first and second upper engaging teeth 71 and 72 of the clutch assembly 76 are disengaged, while the first and second lower engaging teeth 73 and 74 are caused to engage one another. As a result, the rotatory force of the stepping motor 28 ceases to be transmitted to the second transmission gear 81, and the carriage 31 is fixed. Meanwhile, the rotatory force of the output shaft 28a is transmitted to the daisy wheel 27 by means of the intermediate driving gear 29. The wheel 27 is driven to cause one of its types 27a to touch the ink roll 59, for printing of one character on the sheet 32, so that the ink is attached to the surface of the selected type 27a. Thereafter, the type 27a is located in the position facing the hammer 30, by the agency of the stepping motor 28 again. Thus, actuated by the hammer-operating solenoid 60, the hammer 30 strikes against the rear face of the type 27a, thereby accomplishing the printing of the one character.

When moving the carriage 31 whith every one-character printing, on the printing sheet 32, or by operating the keyboard 14, the first switching solenoid 78 is turned on. Thereupon, by the action of the backup member 77, the first and second upper engaging teeth 71 and 72 of the clutch assembly 76 are caused to engage, while the first and second lower engaging teeth 73 and 74 are disengaged from one another. As a result, the carriage 31 is allowed to move, and the rotatory force of the output shaft 28b can be transmitted to the second transmission gear 81. If the second switching solenoid 93 is turned off so that the rotation of the fourth transmission gear 89 cannot be transmitted to the fifth transmission gear 90, the rotatory force of the stepping motor 28 is transmitted to the driving pulley 80. Accordingly, the wire 82 on the pulley 80 is driven, so that the carriage 31 moves in the longitudinal direction of the platen 17.

When moving the carriage 31 from a print ending point to a print starting point of the device, for line printing, the second switching solenoid 93 is turned on. Thereupon, the fourth and fifth gears 89 and 90 are linked, so that the second driving gear 87 can be linked to the worm wheel 92. In this state, if the carriage 31 is moved over a distance for 6 characters, toward the starting point, the second driving gear 87 is driven, through the medium of the guide pulley 85, so that the worm wheel 92 is driven, thus driving the platen 17. As a result, the printing sheet 32, supported on the platen 17, is fed through a predetermined distance. Thus, line feed of the sheet 32 for an entire line is completed, and the second switching solenoid 93 is turned on.

In stopping the operation of the printing device, the operator first disconnects the device from the power supply, by manually turning the main switch 50 and the sub-switch 51 off. Then, he rocks the first and second housings 11 and 12, relatively, to a position such that the housing assembly 10 assumes a flat, rectangular configuration. If the operator should fail to turn the switches 50 and 51 off, the switch operating piece 94 on the first housing 11 would press the sub-switch 51, thereby shutting off the power automatically, as described before. Thus, the power will never fail to be shut off.

The main switch 50 may be omitted, since the sub-switch 51 may substitute for it.

Figure 14:
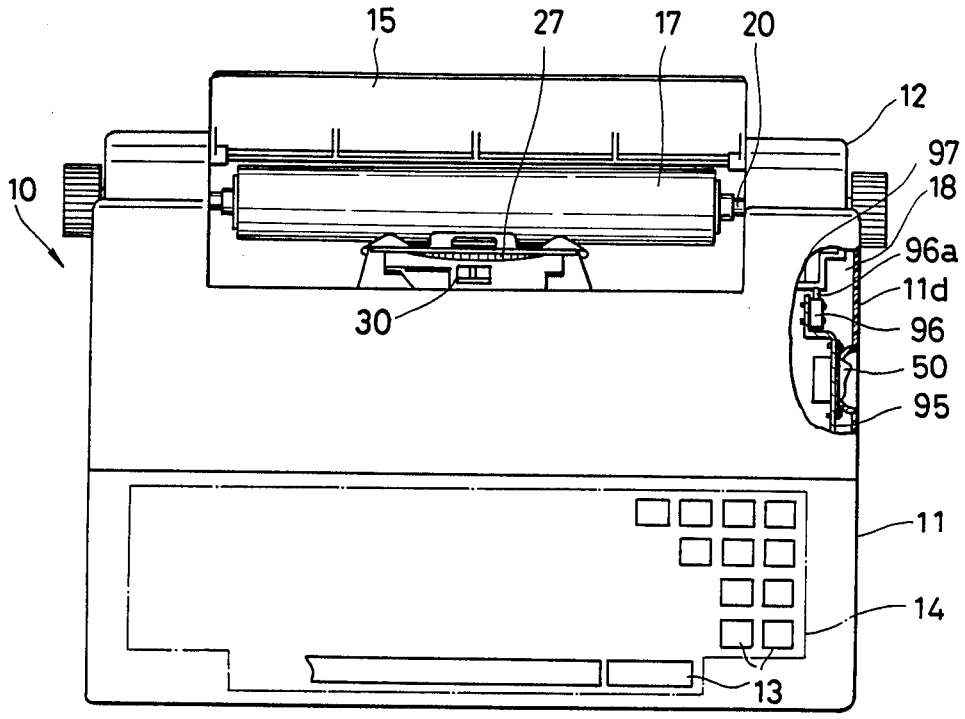
FIG. 14 is a cutaway plan view of a printing device according to a third embodiment of the invention, in the usable position.
Figure 15:
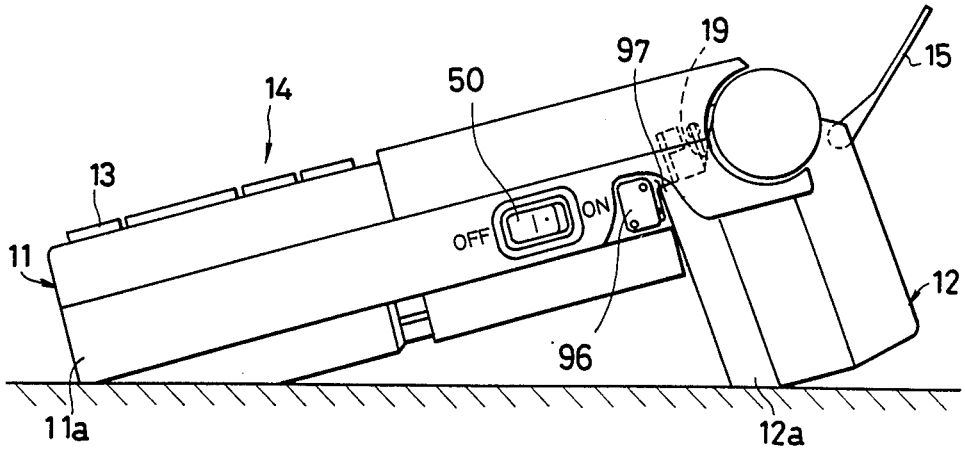
FIG. 15 is a cutaway right-side view of the device shown in FIG. 14.
Figure 16:
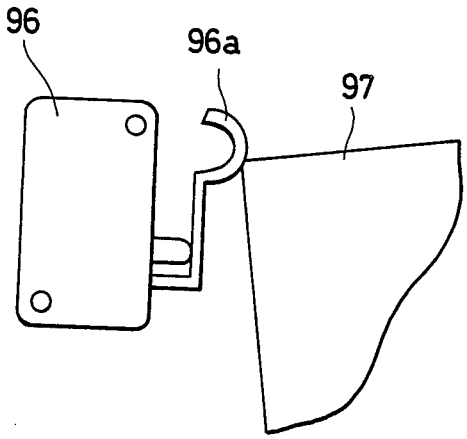
FIG. 16 is an enlarged view of a switch section shown in FIG. 15.

FIGS. 14 to 16 show a third embodiment of the printing device of the present invention. In these drawings, like reference numerals are used to designate like portions as used in the first and second embodiments. A detailed description of those portions is omitted herein.

In the third embodiment, the main switch 50 is attached to a right side wall 11d of the first housing 11, as shown in FIG. 14, so as to be readily accessible to the operator. A limit switch 96, for use as a sub-switch, switch, is attached to a fixed member 95, which is mounted on the right side wall 11d of the first housing 11. Located at the open end portion 18 of the first housing 11, the limit switch 96 constitute power-shut-off switch means.

As the second housing 12 rocks, relatively to the first housing 11, to the usable position, a contact piece 96a of the limit switch 96, in the form of a leaf spring, engages a switch operating end portion 97, which is formed integrally on the bottom plate 12b of the second housing 12, at the open end portion 19 thereof. Thus, the contact piece 96a is pressed against its own resilient force, thereby turning the limit switch 96 on. As long as the second housing 12 is in the usable position, the switch operating end portion 97 goes on pressing the contact piece 96a, as shown in FIGS. 15 and 16, thereby keeping the switch 96 on.

When the second housing 12 is restored to the nonusable position, the switch operating portion 97 is disengaged from the contact piece 96a, so that the piece 96a moves by its own resilient force, thereby turning the limit switch 96 off. Thus, if the operator should fail to return the main switch 50 to the off-position 50, the power would be shut of automatically.

The limit switch 96 and the main switch 50 are connected in the same manner as in the second embodiment.

Also in the third embodiment, only the limit switch 96 may be used, without the use of the main switch 50.

Referring now to FIGS. 17 to 23, a fourth embodiment of the printing device of the present invention will be described. In the description to follow, like reference numerals refer to like portions as used in the first to third embodiments. A detailed description of those portions is omitted herein.

Figure 17:
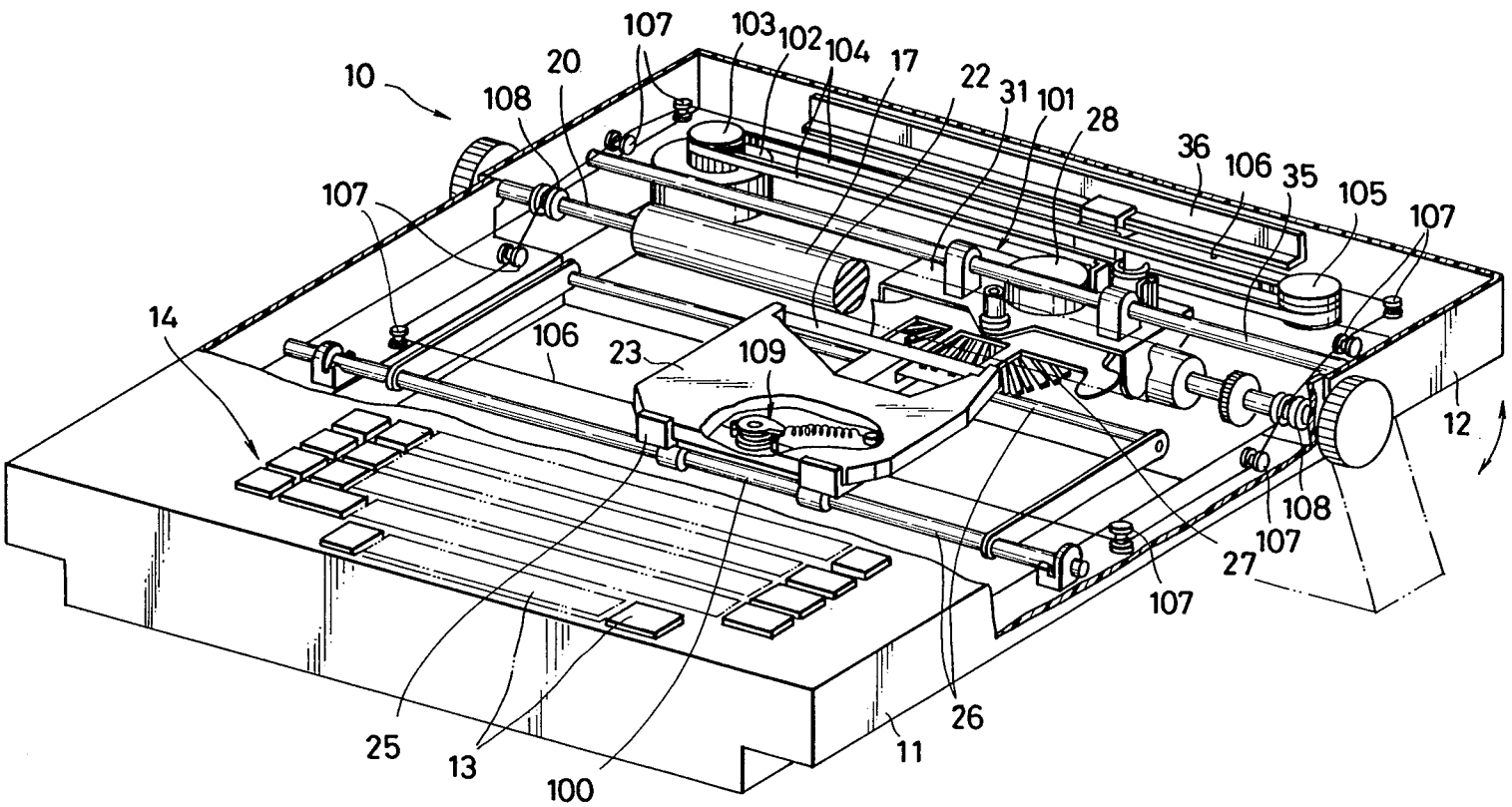
FIG. 17 is a cutaway perspective view showing an outline of a printing device according to a fourth embodiment of the invention.

As shown in FIG. 17, the printing device comprises the housing assembly 10, which includes the first housing 11 on the front side, and the second housing 12 connected to the first housing 11 so as to be rockable relatively thereto. The shaft 20 of the platen 17 serves as an axis of rocking motion of the housings 11 and 12. The device can be brought to the usable position, as indicated by chain line in FIG. 17, by relatively rocking the second housing 12 downward, around the platen shaft 20, from the nonusable position indicated by full line. The first housing 11 carries thereon the keyboard 14 with keys 13, and contains therein the ribbon carriage 25 used to carry and transport the cassette 23 along the print line, and the paired parallel guide shafts 26 supporting the carriage 25. The carriage 25 and the cassette 23 constitute a ribbon cassette unit 100.

Figure 18:
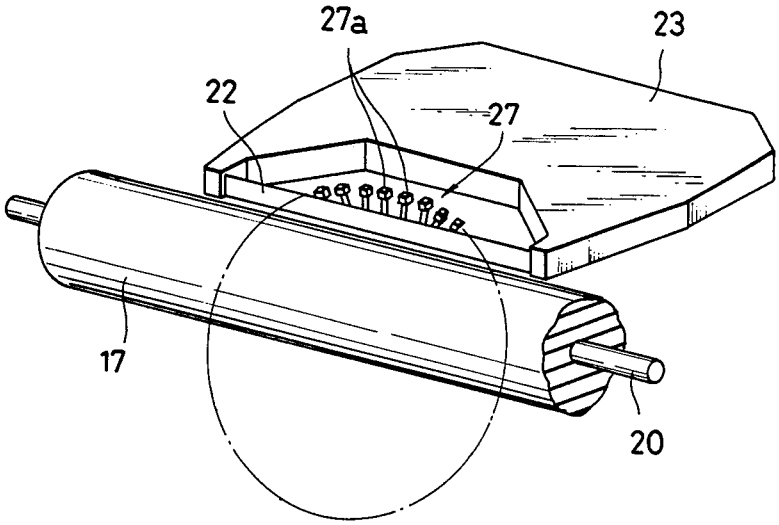
FIG. 18 is a schematic perspective view showing relative positions of a platen and a daisy wheel in a printing position.
Figure 19:
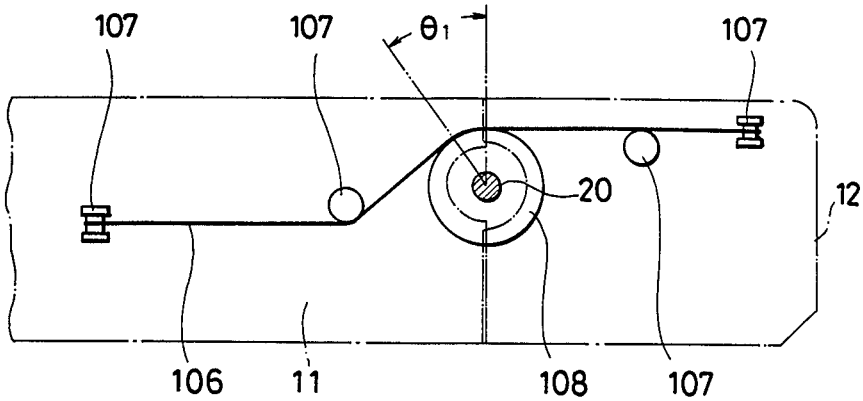
FIGS. 19 and 20 are schematic views showing positions of a drive transmission wire, corresponding to nonusable and usable positions, respectively, of first and second housings.

The second housing 12 contains therein the daisy wheel 27 for use as a printing element, the head carriage 31 for transporting the wheel 27 along the print line, the guide shaft 35, the guide plate 36, and the character selection motor 28. The carriage 31 and the daisy wheel 27 constitute a print head unit 101. The wheel 27, which extends parallel to the bottom plate **12*b* of the second housing 12, is located below and behind the platen 17, when in the nonusable position. When the second housing 12 is rocked to the usable position, the wheel 27 stands upright so that the selected type 27*a* is located at the printing point, facing the platen 17, as shown in FIG. 18**.

The arrangement of the fourth embodiment, as described above, is similar to those of the foregoing embodiments, especially the first embodiment.

A unit drive mechanism is used to drive the ribbon cassette unit 100 and the print head unit 101 synchronously, in order to transport the ribbon cassette 23 and the daisy wheel 27 synchronously along the print line on the platen 17. The drive mechanism will now be described in detail.

A stepping motor 102, for use as a single drive source, is disposed in one rear corner portion of the second housing 12. A driving pulley 103 is operatively coupled to the motor 102. The pulley 103 is also coupled to a driven pulley 105 by means of a toothed belt 104, which is fixed to the print head unit 101. A wire 106, constituting wire means for drive transmission, is wound around the driven pulley 105, for one or more turns, so that there is no slip between the wire 106 and the pulley 105.

The drive transmission wire 106 is connected to the ribbon cassette unit 100 by means of a number of guide rolls 107, which are mounted on the first and second housings 11 and 12. Threading among the guide rolls 107, the wire 106 is partially in contact with the peripheral surface of guide rolls 108, which are fixed on the platen shaft 20, on either side of the platen 17.

Both ends of the wire 106 are coupled to the ribbon cassette unit 100 by means of a tension adjusting mechanism 109.

As the motor 102 rotates, the print head unit 101 travels in one direction, along the print line, driven by the driving pulley 103 and the toothed belt 104. At the same time, the wire 106 is driven by the driven pulley 105, so that the ribbon cassette unit 100 travels in the same direction with the print head unit 101, in synchronism therewith.

The stretch length of the wire 106 varies, depending on the position of the first and second housings 11 and 12. If the angles through which the wire 106 is wound around the guide roll 108, when the housing assembly 10 is in the nonusable and usable positions, are $\theta_1$ and $\theta_2$, respectively, there is a relation $\theta_2 > \theta_1$. Thus, the overall length or stretch length of the wire 106 is longer, by a margin for the difference between angles $\theta_1$ and $\theta_2$, when in the usable position. When the device is restored to the nonusable position, the overall length must be shortened correspondingly.

Figure 21:
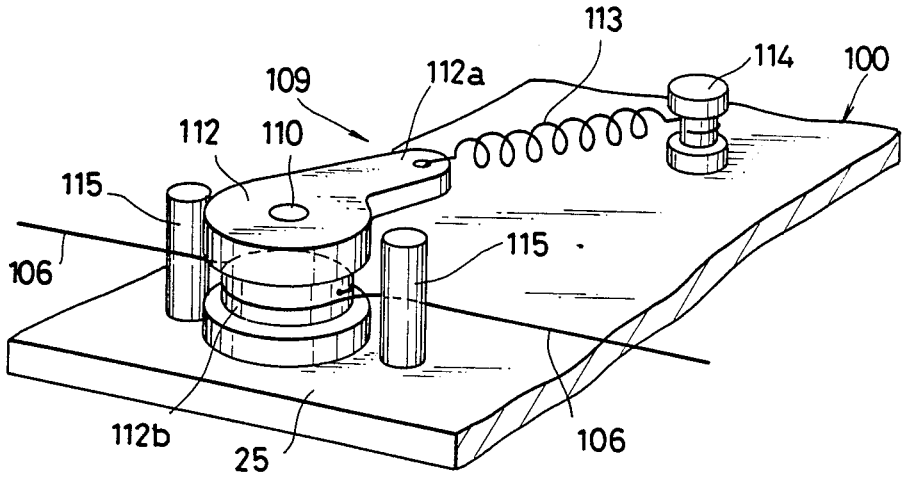
FIG. 21 is an enlarged perspective view schematically showing a tension adjusting mechanism.
Figure 22:
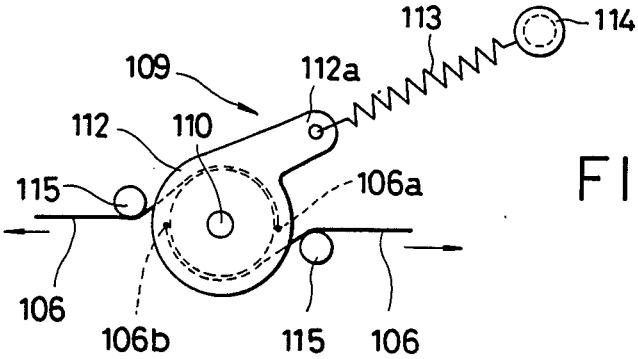
FIGS. 22 and 23 are schematic views for illustrating the operation of the tension adjusting mechanism.

To this end, the printing device of this embodiment is provided with the tension adjusting mechanism 109. As shown in FIG. 21, the mechanism 109 includes a spool member 112 rotatable on a pivot 110, on the ribbon carriage 25 of the ribbon cassette unit 100, and a coil spring 113 for applying a predetermined tension to the member 112. The spring 113 is anchored between a spring anchor portion **112*a* of the spool 112 and a spring anchor pin 114 on the carriage 25**.

Opposite ends **106*a* and 106*b* of the wire 106 are partially wound around and fixed to a peripheral surface 112*b* of the spool 112, in an independent manner. A pair of pins 115 protrude from the carriage 25, spaced in the diametrical direction of the spool 112. The pins 115 serve as guides for regulating the direction in which the wire 106 approaches the spool 112**.

When the housings 11 and 12 are in the nonusable position, the predetermined tension, corresponding to the urging force of the spring 113, is applied to the wire 106 by the tension adjusting mechanism 109. In this state, the spool 112 assumes the angular position shown in FIG. 22.

Figure 20:
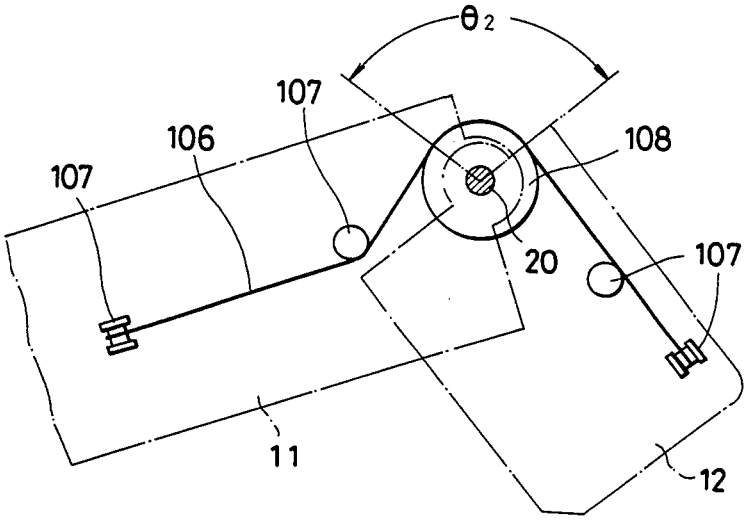
Figure 23:
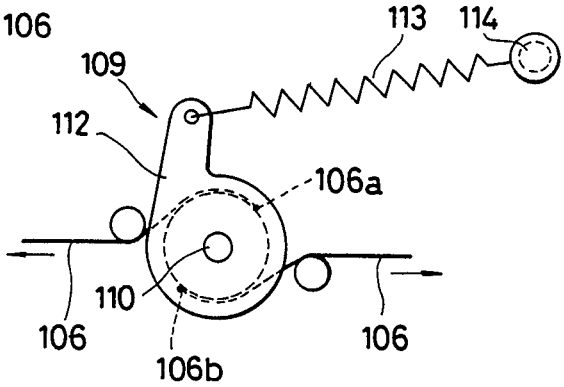

When the housings 11 and 12 are in the usable position, on the other hand, the overall length of the wire 106 must be longer by the length corresponding to the angular difference $(\theta_2-\theta_1)$, as shown in FIG. 20. In this case, the spool 112 is rocked counterclockwise, against the urging force of the spring 113, by the wire 106, as shown in FIG. 23. As the spool 112 rocks in this manner, the wire 106 is drawn out, for a desired length, from the spool 112. In this state, the urging force of the spring 113 acts continually on the wire 106, thus maintaining the predetermined tension.

When the housings 11 and 12 are restored again to the nonusable position, the wire is automatically rolled up for the angular difference $(\theta_2-\theta_1)$. Accordingly, the wire can be prevented from slackening, thus obviating fluctuations of the tension of the wire 106.

Located corresponding to the ribbon cassette unit 100, the tension adjusting mechanism 109 can control the two portions of the wire 16, extending on the opposite sides of the unit 100, under the same conditions, with respect to the roll volume and tension. Thus, the relative positions of the ribbon cassette unit 100 and the print head unit 101 can be kept accurate and fixed.

In this embodiment, moreover, the wire 106 may be replaced with a plastic string member, which may also constitute the wire means for drive transmission.

In the fourth embodiment described above, the wire 106 is used for moving the ribbon cassette unit 100 and the print head unit 101, in synchronism with each other. Alternatively, however, one of the units 100 and 101 may be provided with an arm, which extends therefrom toward the other unit, so that an abutment member, which is provided on the other unit, can engage the arm, without regard to the relative rocking positions of the housing 11 and 12. According to this arrangement using such mechanical contact, as in the fourth embodiment, the units 100 and 101 can be driven by means of a single drive source.

The spirit and scope of the invention should not be limited to any obvious changes of modifications which would occur to those skilled in the art.

What is claimed is:

1. A printing device comprising:

a keyboard;

a first housing mounted with the keyboard and having a first open end portion;

a printing element;

a second housing containing the printing element therein and having a second open end portion, said first and second housings contituting a housing assembly;

said first open end portion and second open end portion abutting against each other and defining an abutment region;

pivot means in said abutment region for pivotally supporting the first and second housings so that the housings can relatively rock around an axis between a nonusable position and a usable position; and a platen disposed in the abutment region, said first and second housings defining a flat, rectangular outline of the housing assembly when in the nonusable position, and a substantially L-shaped outline when in the usable position, and said printing element being brought to a printing position, where the printing element faces the platen, as the second housing rocks relativly to the first housing, from the nonusable position to the usable position.

2. The printing device according to claim 1, wherein said platen defines an axis and wherein said axis of relative rocking motion of the first and second housings is coaxial with the axis of the platen.

3. The printing device according to claim 1, wherein said printing element is formed of a daisy wheel, the plane of said daisy wheel extending substantially parallel to a bottom plate of the second housing.

4. The printing device according to claim 1, wherein resilient closing means is provided between a bottom plate of the first housing and a bottom plate of the second housing, in the abutment region at the open end portions of the first and second housings, and the gap between the bottom plates is always closed, over the range of rocking motion of the housings between the usable and nonusable positions.

5. The printing device according to claim 4, wherein said resilient closing means includes a shutter plate, slidably attached to the bottom plate of the first housing, and a spring member for urging the shutter plate to abut against the bottom plate of the second housing.

6. The printing device according to claim 1, wherein power-shut-off switch means is provided on either of the first and second housings, and a switch operating piece is provided, opposite to the power-shut-off switch means, on the other of the first and second housings, so that the switch operating piece is caused to engage the power-shut-off means, thereby shutting power off, as the second housing rocks relatively to the first housing, from the usable position to the nonusable position.

7. The printing device according to claim 6, wherein said switch means includes a snap switch provided at the open end portion of the second housing, and said switch operating piece protrudes integrally from the open end portion of the first housing.

8. The printing device according to claim 6, wherein said switch means includes a limit switch provided at the open end portion of the first housing, and said switch operating piece is formed integrally with the open end portion of the second housing.

9. The printing device according to claim 1, further comprising:

a ribbon cassette unit disposed in the first housing and supporting a ribbon cassette for movement along a print line;

a print head unit disposed in the second housing and supporting the printing element for movement along the print line;

drive transmission wire means for moving the two units synchronously along the print line;

guide means for guiding the wire means in movement across the abutment region between the first and second housings, said guide means including a pair of guide rollers provided on platen shaft portions, extending individually from two opposite ends of the platen, so that the wire means is passed around the guide rollers;

single drive source means for moving the wire means;

tension adjusting means connected to the wire means and capable of changing the stretch length of the wire means, whereby the tension of the wire means is kept substantially constant.

10. The printing device according to claim 9, wherein said tension adjusting means includes a rotatable spool member and spring means for applying an urging force to the spool member, in the direction opposite to the rotating direction of the spool member, and said wire means has two opposite end portions fixed to and wound around the spool member.

11. The printing device according to claim 10, wherein said tension adjusting means is provided on the ribbon cassette unit.

12. The printing device according to claim 3, wherein said daisy wheel is mounted on a carriage movable along a print line, said carriage carrying thereon ink roll means capable of coming into contact with a selected type on the daisy wheel, said ink roll means, along with the daisy wheel brought to the printing position, rocking relatively to the platen.

* * * * *